US006656345B1

(12) United States Patent
Chen et al.

(10) Patent No.: US 6,656,345 B1
(45) **Date of Patent: *Dec. 2, 2003**

(54) HYDROCARBON CONVERSION TO PROPYLENE WITH HIGH SILICA MEDIUM PORE ZEOLITE CATALYSTS

(75) Inventors: Tan-Jen Chen, Kingwood, TX (US); Mechilium (Marcel) Johannes Gerardus Janssen, Kessel-Lo (BE); Luc Roger Marc Martens, Meise (BE); Machteld Maria Mertens, Boortmeerbeek (BE); Philip Andrew Ruziska, Kingwood, TX (US); Lynn L. Zhao, Caohejing Shanghai (CN); Jannetje Maatje van den Berge, Oostvoorne (NL)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/304,657

(22) Filed: May 4, 1999

Related U.S. Application Data

(60) Provisional application No. 60/084,376, filed on May 5, 1998.

(51) Int. Cl.[7] ..... C10G 11/02; C10G 11/04; C10G 11/00

(52) U.S. Cl. ..... 208/120.01; 208/113; 208/118; 208/119; 585/653

(58) Field of Search ..... 208/113, 118, 208/120.01, 119; 585/653

(56) References Cited

U.S. PATENT DOCUMENTS

| | | | | |
|---|---|---|---|---|
| 4,502,945 A | | 3/1985 | Olbrich et al. | 208/120 |
| 4,922,051 A | | 5/1990 | Nemet-Mavrodin et al. | 585/418 |
| 4,954,243 A | * | 9/1990 | Kuehl et al. | 208/120 |
| 5,389,232 A | | 2/1995 | Adewuyi et al. | 208/120 |
| 5,993,642 A | * | 11/1999 | Mohr et al. | 208/46 |
| 6,069,287 A | * | 5/2000 | Ladwig et al. | 585/648 |
| 6,090,271 A | * | 7/2000 | Carpency et al. | 208/113 |
| 6,258,990 B1 | * | 7/2001 | Fung et al. | 585/330 |
| 6,313,366 B1 | * | 11/2001 | Ladwig et al. | 585/648 |
| 6,315,890 B1 | * | 11/2001 | Ladwig et al. | 208/67 |

FOREIGN PATENT DOCUMENTS

| | | | |
|---|---|---|---|
| EP | 109059 A1 | 5/1984 | |
| EP | 0109060 | 3/1987 | C07C/11/06 |
| EP | 395345 A1 | 10/1990 | |
| EP | 844224 A1 | 5/1998 | |
| EP | 921181 A1 | 6/1999 | |
| WO | WO 96/34930 | 11/1996 | |

* cited by examiner

*Primary Examiner*—Walter D. Griffin
*Assistant Examiner*—Tam M. Nguyen

(57) ABSTRACT

The invention provides a method for converting a hydrocarbon feedstock to propylene comprising: contacting an olefinic hydrocarbon feedstock boiling in the naphtha range with a catalyst comprising a zeolitic catalyst selected from the group consisting of medium pore zeolites having a ratio of silica to alumina above 200 and pore diameter less than 0.7 nm under cracking conditions to selectively produce propylene. The preferred catalyst comprises of a zeolite having an 8, 10, or 12 membered ring pore structure. The preferred catalysts are selected from the group consisting of zeolites from the families MFI, MEL, MTW, TON, MTT, FER, MFS, and the zeolites ZSM-21, ZSM-38 and ZSM-48. Preferably the method is carried out to produce propylene with greater than 50% specificity, more preferably, the propylene to butylene ratio is at least 2:1 or a propylene to ethylene ratio of at least 4:1. The olefinic hydrocarbon feedstock consists essentially of hydrocarbons boiling within the range of 18° to 220° C. (65° F. to 430° F.). The olefinic hydrocarbon feedstock comprises from about 10 wt % to about 70 wt % olefins. Preferably the olefinic hydrocarbon feedstock comprises from about 5 wt % to about 35 wt % paraffins. The catalyst is contacted in the range of 400° C. to 700° C., a weight hourly space velocity ("WHSV") of 1 to 1,000 $hr^{-1}$ and a pressure of 0.1 to 30 atm. absolute.

46 Claims, No Drawings

HYDROCARBON CONVERSION TO PROPYLENE WITH HIGH SILICA MEDIUM PORE ZEOLITE CATALYSTS

This application claims the benefit of provisional patent application No. 60/084,376, filed May 5, 1998, now abandoned.

FIELD OF THE INVENTION

The invention relates to catalytic cracking of hydrocarbons. Particularly the invention relates to a method providing improved selectivity for cracking hydrocarbon feedstocks primarily to propylene by contacting the hydrocarbon under cracking conditions with a catalyst selected from zeolite molecular sieves having a high silica to alumina ratio.

BACKGROUND OF THE INVENTION

Thermal and catalytic conversion of hydrocarbons to olefins is an important industrial process producing millions of pounds of olefins each year. Because of the large volume of production, small improvements in operating efficiency translate into significant profits. Catalysts play an important role in more selective conversion of hydrocarbons to olefins. It is especially desirable to have catalysts available that are highly selective for a particular desired product. However catalytic cracking tends to produce complex mixtures of products with varying degrees of specificity.

Particularly important catalysts are found among the natural and synthetic zeolites. Zeolites are crystalline aluminosilicates with a network of $AlO_4$ and $SiO_4$-tetrahedra linked by oxygen atoms. The negative charge of the network is balanced by the inclusion of protons or cations such as alkali or alkaline earth metal ions. The interstitial spaces or channels formed by the crystalline network enable zeolites to be used as molecular sieves in separation processes and in catalysis. There are a large number of both natural and synthetic zeolitic structures including materials with additional elements such as boron, iron, gallium and titanium. The wide breadth of zeolite structures is illustrated in the "Atlas of Zeolite Structure Types" by W. M. Meier, D. H. Olson and C. Baerlocher (4ed., Elsevier/Intl. Zeolite Assoc. (1996)).

Catalysts containing zeolites, especially medium pore zeolites, are known to be active in cracking light naphtha to light olefins, primarily propylene and butylenes, as well as heavier hydrocarbon streams. For example U.S. Pat. No. 4,922,051 describes the cracking of $C_2$–$C_{12}$ paraffinic hydrocarbons with at least 90 wt % conversion and at least 55% of the sum of $C_2$–$C_4$ and $C_6$–$C_8$ aromatics in the products using a composite catalyst preferably including 25% ZSM-5. U.S. Pat. No. 5,389,232 discloses a process for catalytically cracking a heavy feed in a single riser reactor FCC unit, with delayed riser quench and large amounts of shape selective cracking additive. The feed is preferably quenched after at least 1 second of riser cracking. The catalyst inventory preferably contains over 3.0 wt % ZSM-5,crystal, n the form of an additive of 12–40% ZSM-5 on an amorphous support. Quenching with recycled LCO is preferred. Delayed quenching, with this catalyst system, was reported to produce unexpectedly large amounts of $C_3/C_4$ olefins, with little or no increase in coke make.

However the art has not heretofore included a class of catalysts to selectively crack higher olefin containing hydrocarbon streams to propylene with only small percentages of both ethylene and butylene. Previous naphtha cracking catalysts also produce a substantial percentage of either ethylene or butylene. It is especially unexpected to find a catalyst that produces a high propylene conversion while having only a modest butylene production, and at the same time low ethylene content and low aromatic content in the product mixture. The present invention identifies a group of catalysts with such selectivity.

SUMMARY OF THE INVENTION

The invention provides a method of converting a hydrocarbon feedstock to propylene comprising: contacting an olefinic hydrocarbon feedstock boiling in the naphtha range under catalytic cracking conditions with a catalyst comprising a catalyst selected from the group consisting of medium pore zeolites (<0.7 nm) having a silica to alumina ratio in excess of 200, under cracking conditions to selectively produce a product mixture of predominantly light olefins in which propylene is in excess of 50% of the total products. Preferably the propylene to butylene ratio is at least 2:1 or the propylene to ethylene ratio is at least 4:1. The preferred catalysts are zeolites having an 8,10 or 12 membered ring pore structure. It is especially preferred for the zeolite to be mono-dimensional. The preferred catalysts are selected from the families consisting of MFI, MEL, MTW, TON, MTT, FER, MFS, and the zeolites, ZSM-21, ZSM-38 and ZSM-48. Examples of zeolites in these families include ZSM-5, ZSM-11, ZSM-12, ZSM-22, ZSM-23, ZSM-35 and ZSM-57. Preferably the method is carried out to produce propylene in a propylene to butylene ratio of at least 2:1 or a propylene to ethylene ratio of at least 4:1. The method also preferably produces less than 15 wt % aromatics in the product mixture. The olefinic hydrocarbon feedstock consists essentially of hydrocarbons boiling within the range of −18° to 220° C. (65° F. to 430° F.), preferably in the range of 18° to 148° C. (65° F. to 300° F.). The olefinic hydrocarbon feedstock comprises from about 10 wt % to about 70 wt % olefins, preferably from 20 wt % to 70 wt % olefins. Preferably the olefinic hydrocarbon feedstock comprises from about 5 wt % to about 35 wt % paraffins preferably about 10 wt % to about 30 wt % paraffins, more preferably about 10 wt % to about 25 wt % paraffins. The catalyst is contacted in the range of 400° C. to 700° C., a weight hourly space velocity ("WHSV") of 1 to 1,000 $hr^{-1}$ and a pressure of 0.1 to 30 atm. absolute.

Alternatively the invention may be viewed as a method for producing propylene in a cracking process while minimizing production of butylene which comprises contacting an olefinic hydrocarbon feed with a high silicon zeolite containing catalyst under cracking conditions to produce at least 2 times as much propylene as the total butylenes. Another embodiment views the invention as a method for producing propylene in a cracking process while minimizing production of ethylene which comprises contacting an olefinic hydrocarbon feed with a high silicon zeolite containing catalyst under cracking conditions to produce at least 4 times as much propylene as ethylene. The catalyst choices, feedstocks and conditions are as set out above.

DETAILED DESCRIPTION OF THE INVENTION

The invention is a method for producing high propylene in a catalytic cracking process by contacting an olefinic hydrocarbon feedstock with a medium pore zeolite (<0.7 nm) having a silica to alumina ratio above 200:1 preferably with a zeolite with an eight, ten or twelve membered ring pore structure. It is especially preferred that the zeolite have a monodimensional structure. Preferred olefinic hydrocarbon feedstocks are naphthas in the boiling range of 18° to 220° C. (65° F. to 430° F.). T naphthas may be thermally cracked naphthas or catalytically cracked naphthas. The feed should contain from at least 10 wt % to about 70 wt % olefins, preferably 20 wt % to 70 wt %, and may also include naphthenes and aromatics. For example, the naphtha may be derived from fluid catalytic cracking ("FCC") of gas oils and resids, or from delayed or fluid coking of resids. The preferred naphtha streams are derived from FCC gas oils or resids which are typically rich in olefins and diolefins and relatively lean in paraffins.

Catalytic cracking conditions mean a catalyst contacting temperature in the range of about 400° C. to 750° C.; more preferably in the range of 450° C. to 700° C.; most preferably in the range of 500° C. to 650° C. The catalyst contacting process is preferably carried out at a weight hourly space velocity (WHSV) in the range of about 0.1 $Hr^{-1}$ to about 1,000 $Hr^{-1,}$ more preferably in the range of about 1.0 $Hr^{-1}$ to about 250 $Hr^{-1}$, and most preferably in the range of about 10 $Hr^{-1}$ to about 100 $Hr^{-1}$. Pressure in the contact zone may be from 0.1 to 30 atm. absolute; preferably 1 to 3 atm. absolute, most preferably about 1 atm. absolute. The catalyst may be contacted in any reaction zone such as a fixed bed, a moving bed, a transfer line, a riser reactor or a fluidized bed.

In another embodiment of the invention, the method can be practiced by catalytically cracking an olefinic hydrocarbon feed by contacting it with a mixed catalyst to produce a light olefin containing product. In this embodiment a high silica medium pore zeolite catalyst having a silica to alumina ratio in excess of 200 and pore diameter less than 0.7 nm is mixed with a second cracking catalyst in a quantity sufficient to increase propylene content in the light olefin product while decreasing either ethylene or butylenes when the propylene content of the product composition obtained with the mixed catalyst is compared to the propylene content of the product composition obtained with the second catalyst alone under the same reaction conditions.

Test Conditions

A series of runs in a small bench reactor was conducted on hexene as a model compound. Comparison runs were made with a ZSM-5 zeolite catalyst, from Intercat. Inc., of Sea Girt, N.J. The effluent stream was analyzed by on-line gas chromatography. A column having a length of 60 m packed with fused silica was used for the analysis. The gas chromatograph was a dual flame ionization detector equipped Hewlett-Packard Model 5880. All tabulated data are in weight per cent unless otherwise indicated.

EXAMPLE 1

A 50/50 blend of n-hexane/n-hexene was contacted with (1) a ZSM-48 catalyst, or (2) a ZSM-22, each having a silica to alumina ratio in excess of 1500, and a control ZSM-5 having a silica to alumina ratio of 55. All runs were conducted at 575° C. and a WHSV of 12 $hr^{-1}$. The results are set out in Table 1.

TABLE 1

| Catalyst | ZSM-22 | ZSM-48 | ZSM-5 |
|---|---|---|---|
| Zeolite $SiO_2/Al_2O_3$ Ratio | >1500 | >1500 | 55 |
| Conversion, % | 38.4 | 43.9 | 46.7 |
| Key Results, % | | | |
| Ethylene | 2.1 | 2.5 | 5.6 |
| Propylene | 28.7 | 32.6 | 22.3 |
| Butenes + Butadiene | 3.3 | 5.4 | 13.1 |

TABLE 1-continued

| Catalyst | ZSM-22 | ZSM-48 | ZSM-5 |
|---|---|---|---|
| Aromatics | 0.2 | 0.4 | 1.2 |
| Light Satutrates | 4.0 | 3.0 | 4.5 |
| Selectivity for Propylene, % | 74.9 | 74.2 | 47.8 |
| Propylene/Ethylene Ratio | 13.6 | 13.0 | 4.0 |
| Propylene/Butylene Ratio | 8.7 | 6.0 | 1.7 |

As the data above demonstrate, exceptional propylene selectivity is achieved with the high silica medium pore zeolite catalysts.

EXAMPLE 2

A comparison run to illustrate the effect of silica-to-alumina ratio was obtained under the same conditions as in Example 1 with samples of ZSM-22 differing only in the ratio of silica to alumina. The results are presented in Table 2.

TABLE 2

| Catalyst | ZSM-22 | ZSM-22 |
|---|---|---|
| Zeolite $SiO_2/Al_2O_3$ Ratio | >1500 | 120 |
| Conversion, % | 38.2 | 53.0 |
| Key Results, % | | |
| Ethylene | 2.1 | 6.5 |
| Propylene | 28.7 | 24.6 |
| Butenes + Butadiene | 3.3 | 12.1 |
| Aromatics | 0.2 | 2.3 |
| Light Satutrates | 4.0 | 9.8 |
| Selectivity for Propylene, % | 74.9 | 44.4 |
| Propylene/Ethylene Ratio | 13.7 | 3.8 |
| Propylene/Butylene Ratio | 8.7 | 2.0 |

Although the overall conversion is lower with the high silica catalyst, the specificity for propylene is dramatic. In a proper system recycle of the unconverted hydrocarbon offsets the lower conversion associated with enhanced specificity where propylene demand warrants.

We claim:

1. A method of converting a hydrocarbon feedstock to propylene comprising: contacting an olefinic hydrocarbon feedstock with a catalyst comprising a catalyst selected from the group consisting of medium pore zeolites having a monodimensional structure, a silica to alumina ratio in excess of 200, and a pore diameter less than 0.7 nm, under cracking conditions to selectively produce a product mixture of light olefins in which selectivity to propylene is in excess of 50% on a weight basis.

2. The method of claim 1 wherein the method produces a product mixture having a propylene to butylene ratio of at least 2:1 or a propylene to ethylene ratio of at least 4:1.

3. The method of claim 1 wherein the olefinic hydrocarbon feedstock consists essentially of hydrocarbons boiling within the range of 18° to 220° C.

4. The method of claim 1 wherein the olefinic hydrocarbon feedstock consists essentially of hydrocarbons boiling in the range of 18° to 148° C.

5. The method of claim 1 wherein the olefinic hydrocarbon feedstock comprises from about 10 wt % to about 70 wt % olefins.

6. The method of claim 1 wherein the olefinic hydrocarbon feedstock comprises from about 20 wt % to about 70 wt % olefins.

7. The method of claim 1 wherein the olefinic hydrocarbon feedstock comprises from about 5 wt % to about 35 wt % paraffins.

8. The method of claim 1 wherein the olefinic hydrocarbon feedstock comprises from about 10 wt % to about 25 wt % paraffins.

9. The method of claim 1 wherein the catalyst is contacted in the range of 400° C. to 700° C.

10. The method of claim 1 wherein the catalyst is contacted at a WHSV of 1 to 1,000 hr−1.

11. The method of claim 1 wherein the catalyst is contacted at a pressure of 0.1 to 30 atm. absolute.

12. The method of claim 1 wherein the catalyst comprises a zeolite having an 8, 10, or 12 membered ring pore structure.

13. The method of claim 1 wherein the catalyst comprises a catalyst selected from the group consisting of zeolites from the families MTW, TON, MTT, and the zeolite ZSM-48.

14. The method of claim 1 wherein the hydrocarbon feed is cracked over the catalyst at reactor temperatures of from about 400–700° C., pressures of from about 0.1 atmosphere to about 30 atmospheres absolute, and weight hourly space velocities of from about 0.1 hr−1 to about 1,000 hr−1.

15. In a method for catalytic cracking of an olefinic hydrocarbon feed by contact with a mixed catalyst to produce a light olefin containing product, the improvement which comprises mixing a catalyst selected from the group consisting of high silica medium pore zeolite catalysts having a monodimensional structure, a silica to alumina ratio in excess of 200, and a pore diameter less than 0.7 nm, with a second cracking catalyst in a quantity sufficient to increase propylene content in the light olefin product while decreasing either ethylene or butylenes, when the propylene content of the product composition obtained with the mixed catalyst is compared to the propylene content of the product composition obtained with the second catalyst alone under the same reaction conditions, and to selectively produce a light olefin containing product in which selectivity to propylene is in excess of 50% on a weight basis.

16. The method of claim 15 wherein the method produces a product mixture having a propylene to butylene ratio of at least 2:1 or a propylene to ethylene ratio of at least 4:1.

17. The method of claim 15 wherein the olefinic hydrocarbon feedstock consists essentially of hydrocarbons boiling within the range of 18° to 220° C.

18. The method of claim 15 wherein the olefinic hydrocarbon feedstock consists essentially of hydrocarbons boiling in the range of 18° to 148° C.

19. The method of claim 15 wherein the olefinic hydrocarbon feedstock comprises from about 10 wt % to about 70 wt % olefins.

20. The method of claim 15 wherein the olefinic hydrocarbon feedstock comprises from about 20 wt % to about 70 wt % olefins.

21. The method of claim 15 wherein the olefinic hydrocarbon feedstock comprises from about 5 wt % to about 35 wt % paraffins.

22. The method of claim 15 wherein the olefinic hydrocarbon feedstock comprises from about 10 wt % to about 25 wt % paraffins.

23. The method of claim 15 wherein the catalyst is contacted in the range of 400° C. to 700° C.

24. The method of claim 15 wherein the catalyst is contacted at a WHSV of 1 to 1,000 hr−1.

25. The method of claim 15 wherein the catalyst is contacted at a pressure of 0.1 to 30 atm. absolute.

26. The method of claim 15 wherein the catalyst comprises a zeolite having an 8, 10, or 12 membered ring pore structure.

27. The method of claim 15 wherein the catalyst comprises a catalyst selected from the group consisting of zeolites from the families MTW, TON, MTT, and the zeolite ZSM-48.

28. The method of claim 15 wherein the hydrocarbon feed is cracked over the catalyst at reactor temperatures of from about 400–700° C., pressures of from about 0.1 atmosphere to about 30 atmospheres absolute, and weight hourly space velocities of from about 0.1 hr−1 to about 1,000 hr−1.

29. A method for producing propylene in a cracking process which comprises contacting a hydrocarbon feed with a high silicon zeolite containing catalyst having a monodimensional structure and a silica to alumina ratio in excess of 200 under cracking conditions to selectively produce a product mixture of light olefins in which selectivity to propylene is in excess of 50% on a weight basis, and to produce a product mixture comprising at least 2 times as much propylene as the total butylenes or a product mixture comprising at least 2 times as much propylene as the total ethylene.

30. The method of claim 29 wherein the process produces at least 4 times as much propylene as ethylene.

31. The method of claim 29 wherein the method produces a product mixture having a propylene to butylene ratio of at least 2:1 or a propylene to ethylene ratio of at least 4:1.

32. The method of claim 29 wherein the olefinic hydrocarbon feedstock consists essentially of hydrocarbons boiling within the range of 18° to 220° C.

33. The method of claim 29 wherein the olefinic hydrocarbon feedstock consists essentially of hydrocarbons boiling in the range of 18° to 148° C.

34. The method of claim 29 wherein the olefinic hydrocarbon feedstock comprises from about 10 wt % to about 70 wt % olefins.

35. The method of claim 29 wherein the olefinic hydrocarbon feedstock comprises from 20 wt % to 70 wt % olefins.

36. The method of claim 29 wherein the olefinic hydrocarbon feedstock comprises from about 5 wt % to about 35 wt % paraffins.

37. The method of claim 29 wherein the olefinic hydrocarbon feedstock comprises from about 10 wt % to about 25 wt % paraffins.

38. The method of claim 29 wherein the catalyst is contacted in the range of 400° C. to 700° C.

39. The method of claim 29 wherein the catalyst is contacted at a WHSV of 1 to 1,000 hr−1.

40. The method of claim 29 wherein the catalyst is contacted at a pressure of 0.1 to 30 atm. absolute.

41. The method of claim 29 wherein the catalyst comprises a zeolite having an 8, 10, or 12 membered ring pore structure.

42. The method of claim 29 wherein the catalyst comprises a catalyst selected from the group consisting of zeolites from the families MTW, TON, MTT, and the zeolite ZSM-48.

43. The method of claim 29 wherein the hydrocarbon feed is cracked over the catalyst at reactor temperatures of from about 400–700° C., pressures of from about 0.1 atmosphere to about 30 atmospheres, and weight hourly space velocities of from about 0.1 hr−1 to about 1,000 hr−1.

44. The method of claim 29 wherein the method produces a propylene to butylene ratio of at least 2:1, a propylene to ethylene ratio of at least 4:1 and less than 15 wt % aromatics.

45. The method of claim 1 where in contacting an olefinic hydrocarbon feedstock with a catalyst, the catalyst further comprises a second cracking catalyst.

46. The method of claim 29 where in contacting a hydrocarbon feed with a high silicon zeolites containing catalyst, the catalyst further comprises a second cracking catalyst.

* * * * *